US008410871B2

(12) United States Patent
Kim et al.

(10) Patent No.: US 8,410,871 B2
(45) Date of Patent: Apr. 2, 2013

(54) TUNABLE RESONATOR AND TUNABLE FILTER

(75) Inventors: Chul-soo Kim, Hwaseong-si (KR); Sang-won Yun, Seoul (KR); Young-ho Cho, Seoul (KR); In-sang Song, Seoul (KR); Byeoung-ju Ha, Seongnam-si (KR); Duck-hwan Kim, Goyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 308 days.

(21) Appl. No.: 12/045,850

(22) Filed: Mar. 11, 2008

(65) Prior Publication Data

US 2009/0115555 A1 May 7, 2009

(30) Foreign Application Priority Data

Nov. 1, 2007 (KR) ..... 10-2007-0111046

(51) Int. Cl.
*H01P 1/203* (2006.01)
*H01P 7/08* (2006.01)

(52) U.S. Cl. ..... 333/205; 333/235

(58) Field of Classification Search ..... 333/161, 333/166, 202, 204, 205, 240, 24 C, 238, 246, 333/235, 219

See application file for complete search history.

(56) References Cited

U.S. PATENT DOCUMENTS

| | | | | |
|---|---|---|---|---|
| 7,583,168 | B2 * | 9/2009 | Kawai et al. | 333/238 |
| 2007/0103261 | A1 * | 5/2007 | Kawai et al. | 333/205 |
| 2008/0111652 | A1 * | 5/2008 | Abbaspour-Tamijani et al. | 333/205 |

* cited by examiner

*Primary Examiner* — Benny Lee
*Assistant Examiner* — Gerald Stevens
(74) *Attorney, Agent, or Firm* — NSIP Law

(57) ABSTRACT

A tunable filter is provided which includes a filter unit comprising a pair of microstrips which are disposed facing each other, a capacitor unit connected to one side of the filter unit, and an adjustment unit for regulating the length of each of the pair of microstrips to adjust inductance of the filter unit, the adjustment unit being connected to the opposite side of the filter unit. The length of the microstrips may thereby be regulated in order to vary the frequency band.

8 Claims, 6 Drawing Sheets

TUNABLE RESONATOR AND TUNABLE FILTER

CROSS-REFERENCE TO RELATED APPLICATIONS

This application claims the benefit under 35 U.S.C. §119 (a) of Korean Patent Application No. 10-2007-0111046, filed on Nov. 1, 2007, in the Korean Intellectual Property Office, the entire disclosure of which is hereby incorporated by reference.

BACKGROUND OF THE INVENTION

1. Field of the Invention

The present invention relates to a tunable resonator and a tunable filter. More particularly, the present invention is directed to a tunable resonator and a tunable filter, of which the length of the resonator may be switchably adjusted to allow switching between a plurality of frequency bands.

2. Description of the Related Art

The development of mobile communication and the advent of the Internet have prompted the installation of communication modules in a large number of products. These modules may employ filters that need to satisfy the size and performance demands, for example, combline filters.

FIG. 1 is a diagram showing the configuration of a conventional combline filter 10. The combline filter 10 of FIG. 1 comprises microstrips 11 and 21, one end of each of which is connected directly to a ground, and an opposite end of each of which is connected to the ground via a capacitor.

FIG. 2 is a diagram showing a conventional multi-band front end module (FEM). In FIG. 2, the multi-band FEM includes filters required for each respective band. The multi-band FEM is implemented in such a manner to select a filter for outputting a band required according to a switching operation. However, since such multi-band FEM needs to include as many filters as there are required bands, it is difficult to achieve compactness. Additionally, a large number of microstrips need to be disposed on a substrate in order to form the multi-band FEM using the combline filter, resulting in the increased cost and size of the multi-band FEM.

SUMMARY OF THE INVENTION

Exemplary embodiments of the present invention address at least the above problems and/or disadvantages and provide at least the advantages described below. Accordingly, an exemplary aspect of the present invention is to provide a tunable resonator and a tunable filter, with which the frequency band may be selectively switched.

The foregoing and other objects and advantages are substantially realized by providing a tunable resonator including a line unit formed as a microstrip, a capacitor unit connected to a first side of the line unit, and an adjustment unit for regulating the length of the line unit to adjust an inductance, the adjustment unit being connected to a second side opposite the first side of the line unit.

The adjustment unit may include an auxiliary line unit disposed on one side of the line unit, and a switch for selectively connecting the line unit to the auxiliary line unit in response to an external control signal.

The adjustment unit may include a plurality of auxiliary microstrips having different lengths. The switch may selectively connect the line unit to at least one of the plurality of auxiliary microstrips in response to the external control signal.

The adjustment unit may include a plurality of auxiliary line units sequentially disposed on one side of the adjustment unit, and a plurality of switches for connecting the plurality of auxiliary line units. The plurality of auxiliary line units and plurality of switches may be connected in a cascade configuration.

The plurality of auxiliary microstrips of the plurality of auxiliary line units may have different lengths.

The capacitor unit may include a variable capacitor.

According to another aspect of embodiments of the present invention, a tunable filter includes a filter unit comprising a pair of microstrips which are disposed adjacent to each other, a capacitor unit connected to a first side of the filter unit, and an adjustment unit for regulating the length of each of the pair of microstrips to adjust the inductance of the filter unit, the adjustment unit being connected to a second side of the filter unit opposite the first side.

The adjustment unit may include an auxiliary line unit disposed on one side of the filter unit, and a switch for selectively connecting the filter unit to the auxiliary line unit in response to an external control signal.

The adjustment unit may include a plurality of auxiliary line units sequentially disposed on one side of the filter unit, and a plurality of switches for connecting the plurality of auxiliary line units. The plurality of auxiliary line units and plurality of switches may be connected in a cascade configuration.

The plurality of auxiliary microstrips of the plurality of auxiliary line units may have different lengths.

The capacitor unit may include a variable capacitor.

BRIEF DESCRIPTION OF THE DRAWINGS

The above aspects and features of the present invention will be more apparent by describing certain exemplary embodiments of the present invention with reference to the accompanying drawings, in which.

Throughout the drawings, the same drawing reference numerals will be understood to refer to the same elements, features and structures.

DETAILED DESCRIPTION OF EXEMPLARY EMBODIMENTS

Certain exemplary embodiments of the present invention will now be described in greater detail with reference to the accompanying drawings.

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
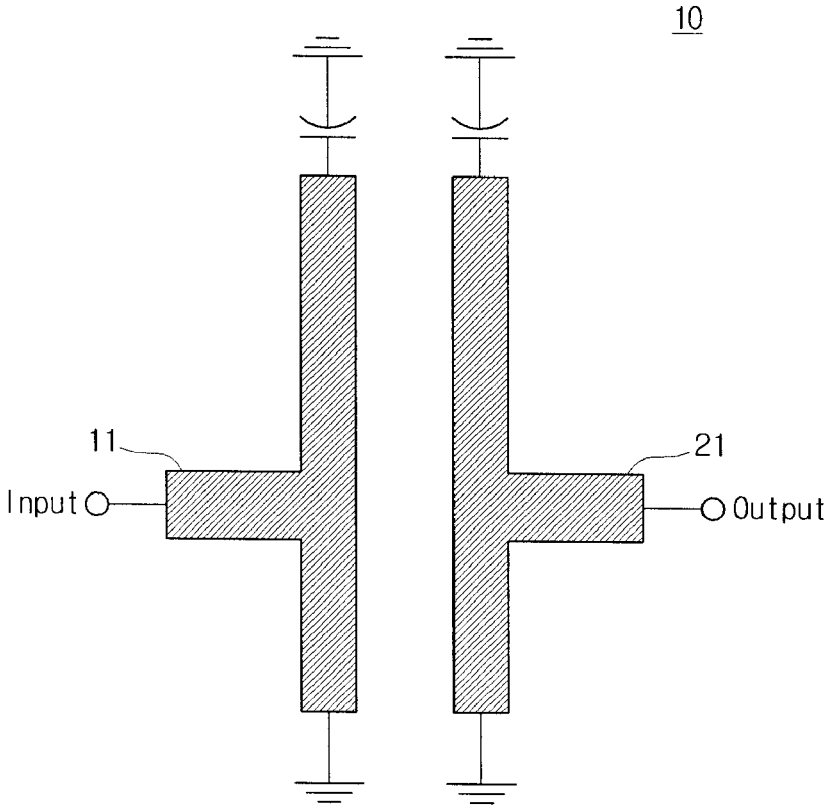
FIG. 1 (PRIOR ART)
FIG. 1 is a diagram showing the configuration of a conventional combline filter.
Figure 2:
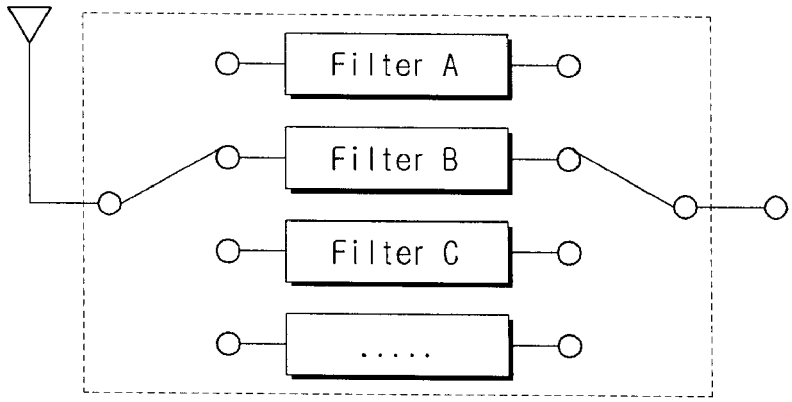
FIG. 2 (PRIOR ART)
FIG. 2 is a diagram showing a conventional multi-band front end module (FEM)
Figure 3:
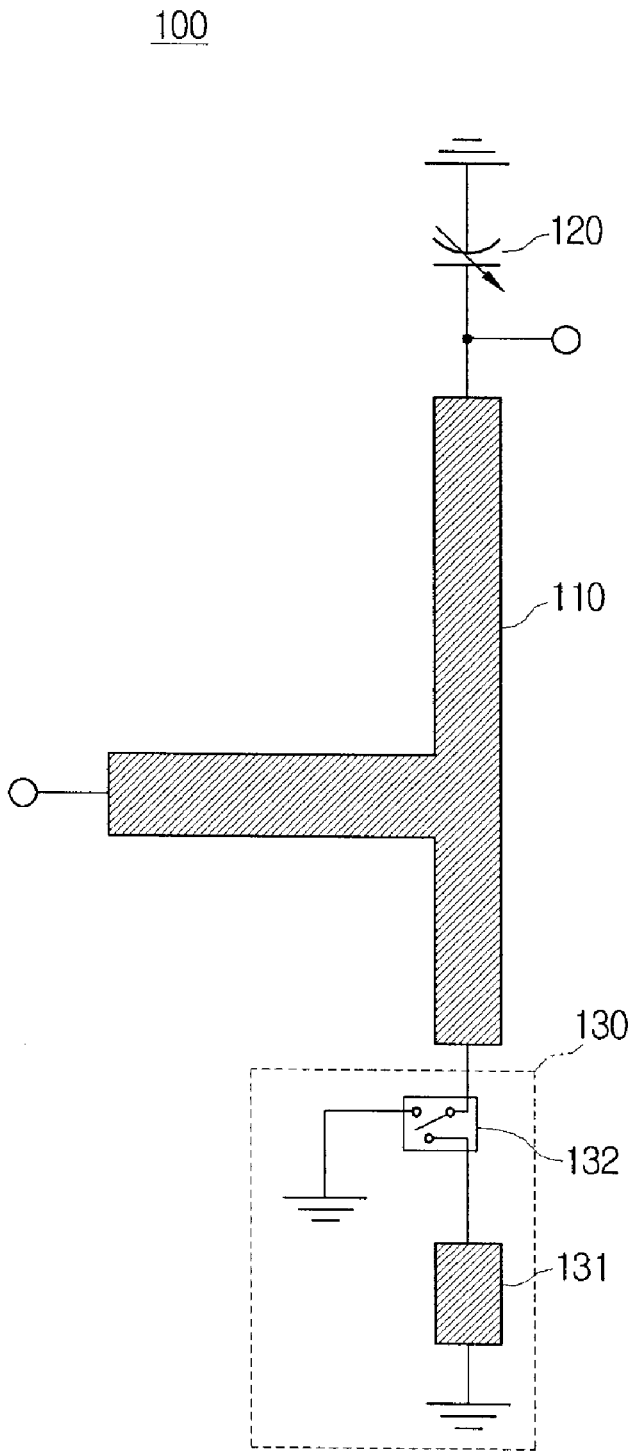
FIG. 3 is a diagram showing the configuration of a tunable resonator according to an exemplary embodiment of the present invention.

FIG. 3 is a diagram showing the configuration of a tunable resonator 100 according to an exemplary embodiment of the present invention. The tunable resonator 100 of FIG. 3 includes a line unit 110, a capacitor unit 120 and an adjustment unit 130.

The line unit 110 is formed as a microstrip. The line unit 110 includes an input terminal and an output terminal. One end of the microstrip is connected to one side of the adjustment unit 130, and the opposite end is connected to one side of the capacitor unit 120 having a capacitance component. Specifically, the resonant frequency of the microstrip may be determined according to the magnitude of the inductance component of the microstrip and the magnitude of the capacitance component of the capacitor unit 120 connected to one end of the microstrip. The width and length of the microstrip may affect the inductance of the microstrip. For example, the longer the microstrip is, the greater will be the inductance.

The capacitor unit 120 is connected to one side of the line unit 110, and provides the capacitance component between the line unit 110 and the ground. Specifically, the capacitor unit 120 includes a capacitor, and one side of the capacitor unit 120 is connected to the line unit 110 and the opposite side is connected to the ground.

The capacitor unit 120 may include a variable capacitor. Accordingly, the capacitance may be adjusted and the resonant frequency of the tunable resonator 100 may thus be made to vary. Such variable capacitor may be implemented as a Microelectromechanical systems (MEMS) switch and a plurality of capacitors. More particularly, such MEMS switch may be connected to the line unit 110, and switchably connect thereto one or more of the plurality of capacitors. In this example, the variable capacitor may comprise only a compact MEMS switch and capacitors, so it is possible to make the tunable resonator 100 compact.

The adjustment unit 130 may be connected to the side opposite the side of the line unit 110, to which the capacitor 120 is connected. The adjustment unit 130 may regulate the length of the line unit 110 in order to adjust the composite inductance. The adjustment unit 130 may comprise an auxiliary line unit 131 and a switch 132.

The auxiliary line unit 131 may be formed as an auxiliary microstrip in the same manner as the microstrip of the line unit 110. The auxiliary line unit 131 may comprise a plurality of auxiliary microstrips. Such an auxiliary microstrip functions to extend the length of the microstrip of the line unit 110. In this exemplary embodiment of the present invention, the auxiliary microstrip may have the same width as the microstrip of the line unit 110.

The switch 132 includes a plurality of ports, and may selectively connect the line unit 110 to the auxiliary line unit 131. Specifically, the switch 132 may cause the line unit 110 to be either directly connected to the ground or to be connected to the auxiliary line unit 131 in response to an external control signal.

For example, if the switch 132 is in an OFF state, that is, if the line unit 110 is directly connected to the ground, only the microstrip of the line unit 110 may contribute to the resultant inductance, so that the resonant frequency may be generated according to the magnitude of the inductance component corresponding to the length of the microstrip. Alternatively, if the switch 132 is in an ON state, that is, if the line unit 110 is connected to the ground via the auxiliary line unit 131, the resultant inductance may include contributive components corresponding to both the length of the microstrip of the line unit 110 and the length of the auxiliary microstrip 131, so that the tunable resonator 100 may have a greater inductance than when the switch 132 is in an OFF state. The resonant frequency may be reduced as the inductance increases. Accordingly, the inductance is inversely proportional to the resonant frequency.

The adjustment unit 130 may include a plurality of auxiliary line units 131, which are sequentially disposed on one side of the line unit 110, and a plurality of switches 132 for connecting the plurality of auxiliary line units 131 in a cascade configuration. Here, a single auxiliary line unit 131 and a single switch 132 form a pair, and a plurality of pairs of the auxiliary line unit 131 and the switch 132 are sequentially arranged in a cascade configuration. Each of the plurality of switches 132 is sequentially connected to the ground or to the plurality of auxiliary line units 131 in response to an external control signal, and the microstrip of the line unit 110 may thus be made longer. Accordingly, the composite inductance of the tunable resonator 100 may become increasingly larger, so it is possible to provide a variety of resonant frequencies.

In this situation, if the microstrips of the plurality of auxiliary line units 131 have the same length, the resonant frequency may be linearly controlled. Alternatively, if the microstrips of the plurality of auxiliary line units 131 have different lengths, the resonance may be varied non-linearly.

Therefore, the tunable resonator 100 of FIG. 3 may adjust not only the capacitance but also the inductance, so the range of variation of the resonant frequency may be made broader.

Figure 4:
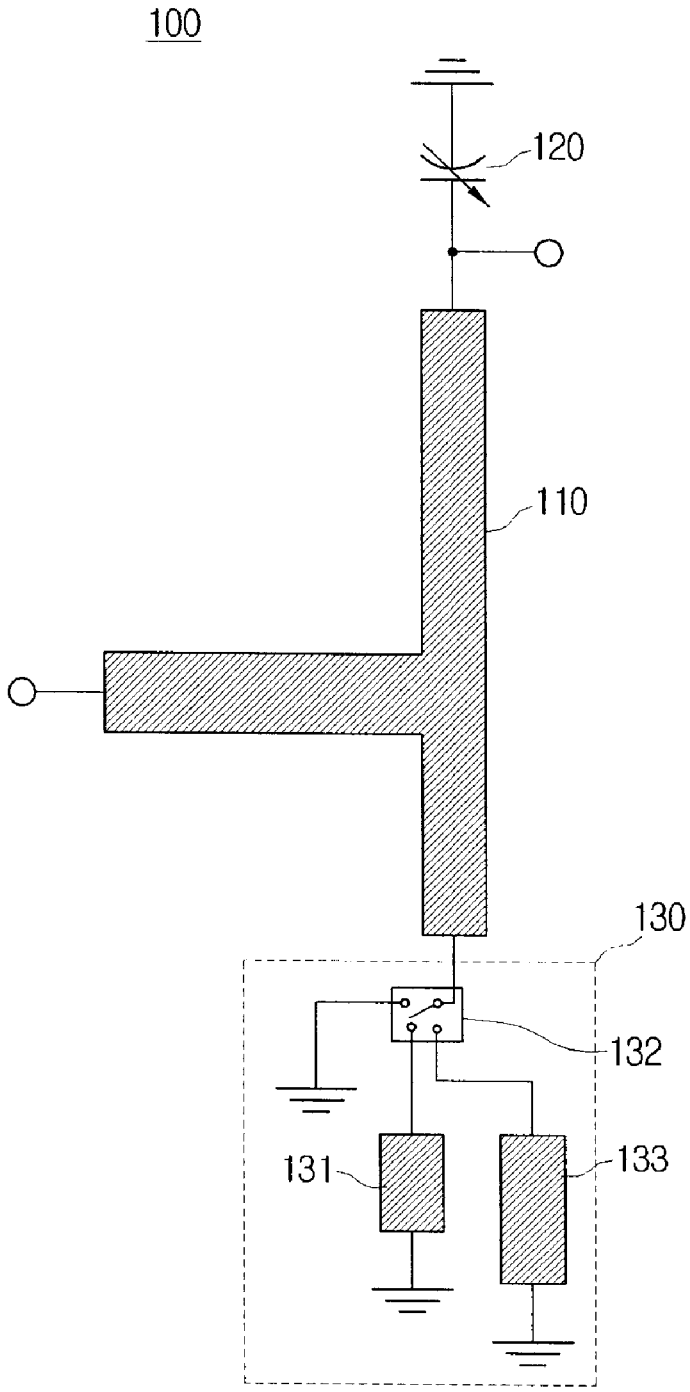
FIG. 4 is a diagram showing the configuration of a tunable resonator according to another exemplary embodiment of the present invention.

FIG. 4 is a diagram showing the configuration of a tunable resonator 100 according to another exemplary embodiment of the present invention. The adjustment unit 130 of FIG. 4 may comprise a plurality of auxiliary microstrips 131 and 133 having different lengths. Additionally, the adjustment unit 130 of FIG. 4 may include a switch 132 for selectively connecting the line unit 110 and one of the auxiliary microstrips 131 and 133 in response to an external control signal. Specifically, the switch 132 includes a plurality of ports, and may be connected to the plurality of auxiliary microstrips. For example, the switch 132 may select one auxiliary microstrip from among the plurality of auxiliary microstrips and connect the selected microstrip to the line unit 110 in response to an external control signal. Accordingly, inductance having different magnitudes may be added, so it is possible to achieve variable resonant frequency.

Although only the two auxiliary microstrips 131 and 133 are shown in this example to form the tunable resonator 100, the tunable resonator may also be formed with more than two auxiliary microstrips.

Figure 5:
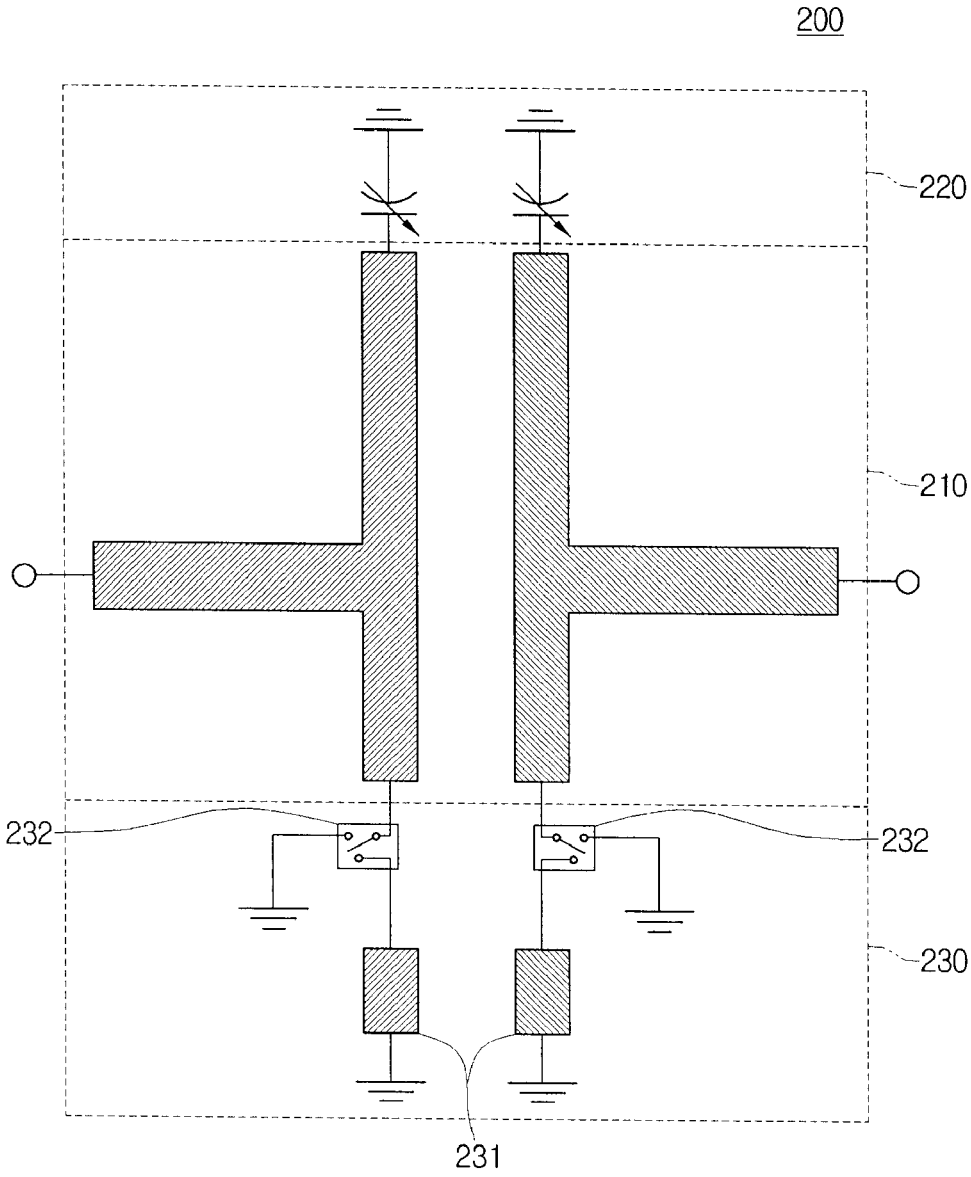
FIG. 5 is a diagram showing the configuration of a tunable filter according to an exemplary embodiment of the present invention.

FIG. 5 is a diagram showing the configuration of a tunable filter 200 according to an exemplary embodiment of the present invention. The tunable filter 200 of FIG. 5 includes a filter unit 210, a capacitor unit 220 and an adjustment unit 230.

The filter unit 210 is formed as a pair of microstrips, which are disposed adjacent to each other. Additionally, the filter unit 210 includes an input terminal and an output terminal. The pair of microstrips are disposed between the input terminal and the output terminal, and thus signals transferred via the input terminal may be filtered and the filtered signals may be output via the output terminal. The filter unit 210 has a combline structure. One end of the microstrip is connected to one side of the adjustment unit 230 and the opposite end is connected to one side of the capacitor unit 220 having a capacitance component. A frequency band of the microstrip may change according to the magnitude of the inductance component of the microstrip and the magnitude of the capacitance component of the capacitor unit 220 and according to the level of coupling between microstrips.

The tunable filter 200 may be constructed using a plurality of tunable resonators 100 of FIG. 3, by, e.g., coupling a plurality of tunable resonators 100 to each other.

The capacitor unit 220 is connected to one side of the filter unit 210, and provides the capacitance component between the filter unit 210 and the ground. Specifically, one side of the capacitor unit 220 is connected to the filter unit 210, and the opposite side is connected to the ground.

The capacitor unit 220 may be a variable capacitor. Accordingly, a capacitance may be adjusted, thus causing the frequency band of the tunable filter 200 to vary. Such a variable capacitor may be implemented as an MEMS switch and a plurality of capacitors. More particularly, such MEMS switch may be connected to the filter unit 210, and switchably connect thereto one or more of the plurality of capacitors. In this example, the variable capacitor may comprise only a compact MEMS switch and capacitors, and the size of the tunable filter 200 may thus be reduced.

The adjustment unit 230 is connected to the opposite side of the filter unit 210, to increase inductance of the filter unit 210. The adjustment unit 130 may comprise an auxiliary line unit 231 and a switch 232.

The auxiliary line unit 231 may be formed as an auxiliary microstrip in the same manner as the microstrip of the filter unit 210. Such an auxiliary microstrip functions to extend the length of the microstrip of the filter unit 210. In this exemplary embodiment, the auxiliary microstrip may have the same width as the microstrip of the filter unit 210.

The switch 232 includes a plurality of ports, and may selectively connect the filter unit 210 to the auxiliary line unit 231 in response to an external control signal. The switch 232 may be turned on or off in response to an external control signal, so that the filter unit 210 may be either directly connected to the ground or connected to the auxiliary line unit 231.

For example, if the switch 232 is in an OFF state, that is, if the filter unit 210 is directly connected to the ground, only the microstrip of the filter unit 210 may contribute to the resultant inductancet, so that the frequency bandwidth may be generated according to the magnitude of the inductance component corresponding to the length of the microstrip. Alternatively, if the switch 232 is in an ON state, that is, if the filter unit 210 is connected to the ground via the auxiliary line unit 231, the filter unit 210 may have an inductance corresponding to both the length the microstrip of the filter unit 210 and the length of the auxiliary microstrip, so that the tunable filter 200 may have a greater inductance than when the switch 232 is in an OFF state. Additionally, the frequency bandwidth may be reduced as the inductance increases. Accordingly, the inductance is inversely proportional to the resonant frequency.

In the tunable filter 200 of FIG. 5, the filter unit 210 may be connected to the auxiliary line unit 231 or to the ground in response to the external control signal, so that the length of the microstrip of the tunable filter 200 may be adjusted, and thus the inductance may be varied. Therefore, a compact multi-band front end module (FEM) may be implemented using a single filter. Additionally, the tunable filter 200 may change not only the capacitance but also the inductance, and various frequency bandwidth patterns may thus be realized.

Figure 6:
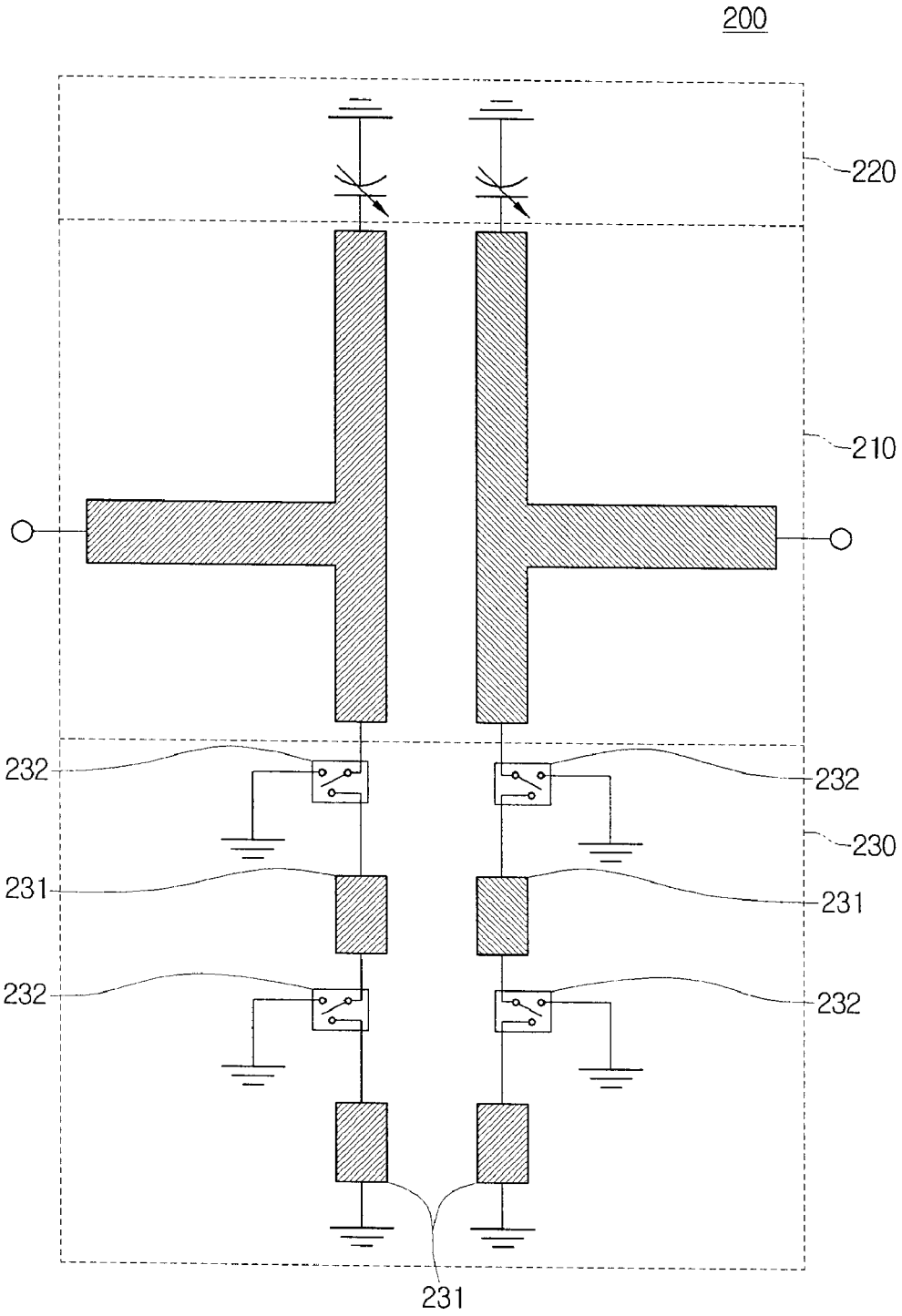
FIG. 6 is a diagram showing the configuration of a tunable filter according to another exemplary embodiment of the present invention.

FIG. 6 is a diagram showing the configuration of a tunable filter 200 according to another exemplary embodiment of the present invention. The adjustment unit 230 of FIG. 6 may include a plurality of auxiliary line units 231 and a plurality of switches 232. Specifically, a single auxiliary line unit 231 and a single switch 232 form a pair, and a plurality of pairs of the auxiliary line unit 231 and the switch 232 are sequentially arranged in a cascade configuration. Each of the plurality of switches 232 is sequentially connected to the ground or to the plurality of auxiliary line units 231 in response to an external control signal, and the microstrip of the filter unit 210 may thus be made longer. Accordingly, a variety of frequency bandwidths may be implemented using the tunable filter 200 of FIG. 6.

Additionally, if the microstrips of the plurality of auxiliary line units 231 have the same length, the frequency bandwidth may be linearly controlled. Alternatively, if the microstrips of the plurality of auxiliary line units 231 have different lengths, nonlinear frequency bandwidths may be formed.

Although two auxiliary line units 231 are used to construct the tunable filter 200 of FIG. 6, more than two auxiliary line units may also be used.

Figure 7:
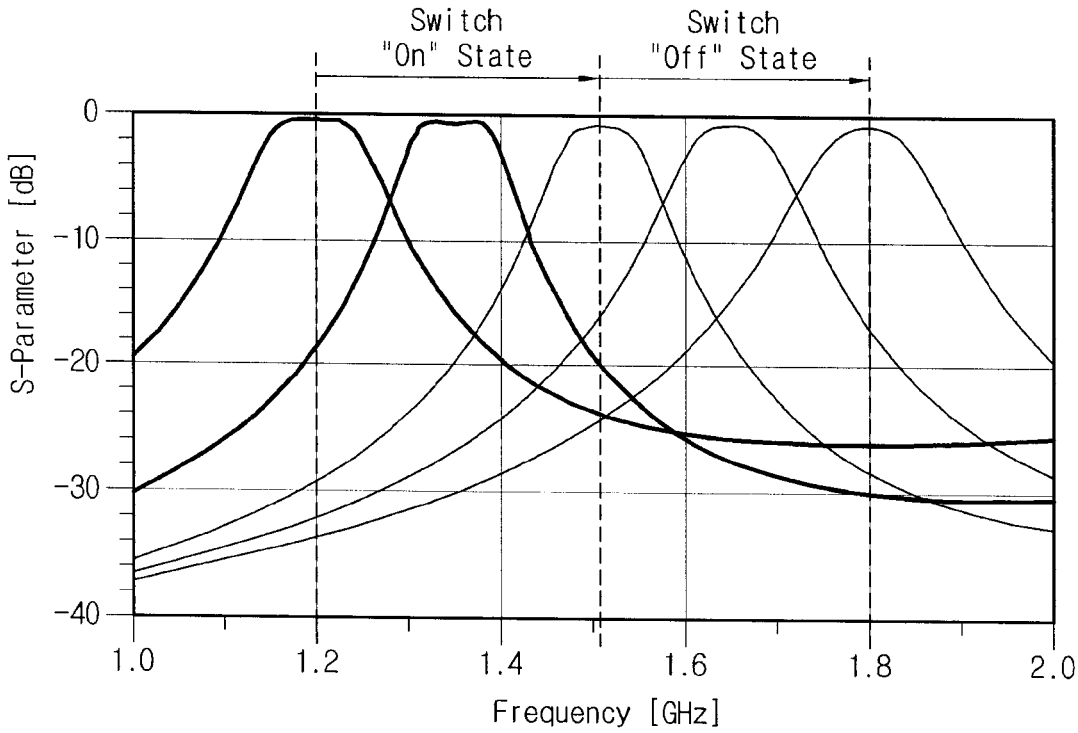
FIG. 7 is a graph showing bandwidth variation of a tunable filter according to an exemplary embodiment of the present invention.

FIG. 7 is a graph showing variation in the bandwidth of a tunable filter according to an exemplary embodiment of the present invention. As shown in FIG. 7, various frequency patterns may be formed in a frequency band between approximately 1.2 GHz and approximately 1.8 GHz as the magnitude of the capacitance component changes and the length of microstrips increases.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A tunable resonator comprising:

a line unit formed as a microstrip;

a capacitor unit connected to a first side of the line unit; and an adjustment unit for regulating a length of the line unit to adjust inductance, the adjustment unit being connected to a second side of the line unit opposite the first side, wherein the adjustment unit comprises:

a plurality of auxiliary line units disposed on the second side of the line unit; and a multi-port switch for selectively connecting the line unit to one of the plurality of auxiliary line units in response to an external control signal, wherein a first port of the multi-port switch is connected to a first auxiliary line unit of the plurality of auxiliary line units, and a second port of the multi-port switch is connected to a second auxiliary line unit of the plurality of auxiliary line units.

2. The tunable resonator of claim 1, wherein the plurality of auxiliary line units comprises a plurality of auxiliary microstrips having different lengths.

3. The tunable resonator of claim 1, wherein the capacitor unit comprises a variable capacitor.

4. The tunable resonator of claim 1, wherein a third port of the multi-port switch is connected to a third auxiliary line unit of the plurality of auxiliary line units.

5. The tunable resonator of claim 1, wherein a third port of the multi-port switch is connected to ground.

6. A tunable filter comprising:

a filter unit comprising a pair of microstrips which are disposed adjacent to each other;

a capacitor unit connected to a first side of the filter unit; and an adjustment unit for regulating a length of each of the pair of microstrips to adjust an inductance of the tunable filter, the adjustment unit being connected to a second side opposite the first side of the filter unit, wherein the adjustment unit comprises:

a plurality of auxiliary line units disposed on the second side of the filter unit; and a multi-port switch for selectively connecting the filter unit to one of the plurality of auxiliary line units in response to an external control signal, wherein:

a first port of the multi-port switch is connected to one end of a first auxiliary line unit of the plurality of auxiliary line units, another end of the first auxiliary line unit is connected to one port of another multi-port switch, and another port of the other multi-port switch is connected to a second auxiliary line unit of the plurality of auxiliary line units.

7. The tunable filter of claim 6, wherein the capacitor unit comprises a variable capacitor.

8. The tunable filter of claim 6, wherein:

the plurality of auxiliary line units comprises a plurality of auxiliary microstrips having different lengths.

* * * * *